US008439340B2

(12) United States Patent
Maenishi et al.

(10) Patent No.: US 8,439,340 B2
(45) Date of Patent: May 14, 2013

(54) SHEET PROCESSING APPARATUS AND IMAGE FORMING SYSTEM

(75) Inventors: Hiromasa Maenishi, Matsudo (JP); Mitsuhiko Sato, Kashiwa (JP); Naoto Watanabe, Abiko (JP); Yushi Oka, Abiko (JP); Toshiyuki Miyake, Abiko (JP); Takashi Yokoya, Kashiwa (JP); Yutaka Ando, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 13/198,135

(22) Filed: Aug. 4, 2011

(65) Prior Publication Data

US 2012/0043713 A1 Feb. 23, 2012

(30) Foreign Application Priority Data

Aug. 19, 2010 (JP) ..... 2010-183600

(51) Int. Cl.
*B65H 37/06* (2006.01)

(52) U.S. Cl.
USPC ..... 270/32; 270/45; 270/39.06; 493/444; 493/445

(58) Field of Classification Search ..... 493/444, 493/445; 270/32, 37, 39.06, 45
See application file for complete search history.

(56) References Cited

U.S. PATENT DOCUMENTS

| | | | | |
|---|---|---|---|---|
| 4,643,705 | A * | 2/1987 | Bober | 493/444 |
| 5,735,515 | A | 4/1998 | Hayashi et al. | |
| 5,769,406 | A | 6/1998 | Sato | |
| 6,374,077 | B1 | 4/2002 | Hirai et al. | |
| 7,134,370 | B2 | 11/2006 | Murata et al. | |
| 7,575,227 | B2 | 8/2009 | Suzuki et al. | |
| 7,845,625 | B2 | 12/2010 | Suzuki et al. | |
| 7,862,016 | B2 * | 1/2011 | Takemoto et al. | 270/37 |
| 7,938,388 | B2 | 5/2011 | Fujii et al. | |
| 8,027,044 | B2 | 9/2011 | Sato et al. | |
| 8,220,791 | B2 * | 7/2012 | Suzuki et al. | 270/45 |
| 8,256,758 | B2 * | 9/2012 | Kobayashi et al. | 270/45 |
| 2007/0045921 | A1 | 3/2007 | Suzuki et al. | |
| 2007/0138726 | A1 * | 6/2007 | Tamura et al. | 270/37 |
| 2009/0256301 | A1 | 10/2009 | Suzuki et al. | |
| 2009/0258774 | A1 * | 10/2009 | Suzuki et al. | 493/442 |
| 2010/0247203 | A1 | 9/2010 | Watanabe et al. | |
| 2010/0314049 | A1 | 12/2010 | Yamauchi et al. | |
| 2011/0008089 | A1 | 1/2011 | Watanabe et al. | |
| 2011/0064541 | A1 * | 3/2011 | Kikkawa et al. | 412/13 |

FOREIGN PATENT DOCUMENTS

| | | | |
|---|---|---|---|
| EP | 1760023 | A2 | 3/2007 |
| JP | 2012140215 | A * | 7/2012 |

* cited by examiner

*Primary Examiner* — Patrick Mackey
(74) *Attorney, Agent, or Firm* — Fitzpatrick, Cella, Harper & Scinto

(57) ABSTRACT

A finisher includes an intermediate tray that collects sheets to form a sheet bundle, a sheet gripping member that grips one end of the sheet bundle in a conveying direction and a positioning member that grips the other end of the sheet bundle in a conveying direction, a moving portion that moves the sheet gripping member and the positioning member to come close to each other, a pair of folding rollers that folds the sheet bundle while conveying the sheet bundle, a projecting member that projects a part between the one end and the other end of the gripped sheet bundle toward the pair of folding rollers, and a controller that controls the moving portion, such that the sheet gripping member and the positioning member come close to each other in synchronization with an operation of projecting the projecting member toward the sheet bundle.

10 Claims, 16 Drawing Sheets

SHEET PROCESSING APPARATUS AND IMAGE FORMING SYSTEM

BACKGROUND OF THE INVENTION

1. Field of the Invention

The present invention relates to a sheet processing apparatus that performs a sheet folding process and an image forming system.

2. Description of the Related Art

Conventionally, there are well-known various kinds of sheet processing apparatuses that process a bundle of plural sheets, discharged from an image forming apparatus such as a printer, a copying machine, and a facsimile machine. The sheet processing apparatus includes a stacking portion on which the sheet is stacked, and has a function of collectively performing the folding process to perform a bookbinding process when a sheet bundle is formed by the plural sheets. For example, US Patent Application Publication No. 2007/0045921 discusses a sheet processing apparatus.

The sheet processing apparatus discussed in US Patent Application Publication No. 2007/0045921 moves a lower stopper of the stacking portion to support the folding process during the sheet bundle folding process. According to the sheet processing apparatus of US Patent Application Publication No. 2007/0045921, an alignment property is improved because a folding position can be adjusted according to a size of the sheet bundle.

However, in the sheet processing apparatus of US Patent Application Publication No. 2007/0045921, the folding process is performed without fixing the sheet bundle when the sheet bundle folding process is performed. Therefore, the sheet bundle is folded while four sides of the sheet bundle vary during the folding process, and possibly quality of bookbinding state is degraded.

SUMMARY OF THE INVENTION

The present invention provides a sheet processing apparatus that improves the quality of the bookbinding state such that a sheet bundle is folded while sides of one end part and the other end part of the sheet bundle are aligned.

According to an aspect of the present invention, a sheet processing apparatus includes a conveying portion that conveys a sheet, a collecting portion that collects the sheets conveyed by the conveying portion and forms a sheet bundle, a one-end gripping member that grips one end in a sheet conveying direction of the sheet bundle stacked on the collecting portion, an other-end gripping member that grips the other end in the sheet conveying direction of the sheet bundle stacked on the collecting portion, a moving portion that moves the one-end gripping member and the other-end gripping member so as to come close to each other, a pair of rollers that conveys the sheet bundle while nipping the sheet bundle, thereby folding the sheet bundle, a projecting member that projects a part between the one end and the other end of the sheet bundle gripped by the one-end gripping member and the other-end gripping member toward the pair of rollers, and a controller that controls the moving portion such that the one-end gripping member and the other-end gripping member come close to each other in synchronization with an operation of projecting the projecting member toward the sheet bundle.

Further features of the present invention will become apparent from the following description of exemplary embodiments with reference to the attached drawings.

DESCRIPTION OF THE EMBODIMENTS

Hereinafter, an exemplary embodiment of the invention will be described in detail. Sizes, materials, shapes and relative positions of components described in the embodiment are appropriately changed according to configurations and various conditions of the apparatus to which the invention is applied. Therefore, the scope of the invention is not limited to the sizes, materials, shapes or relative positions unless otherwise noted.

Embodiment

Figure 1:
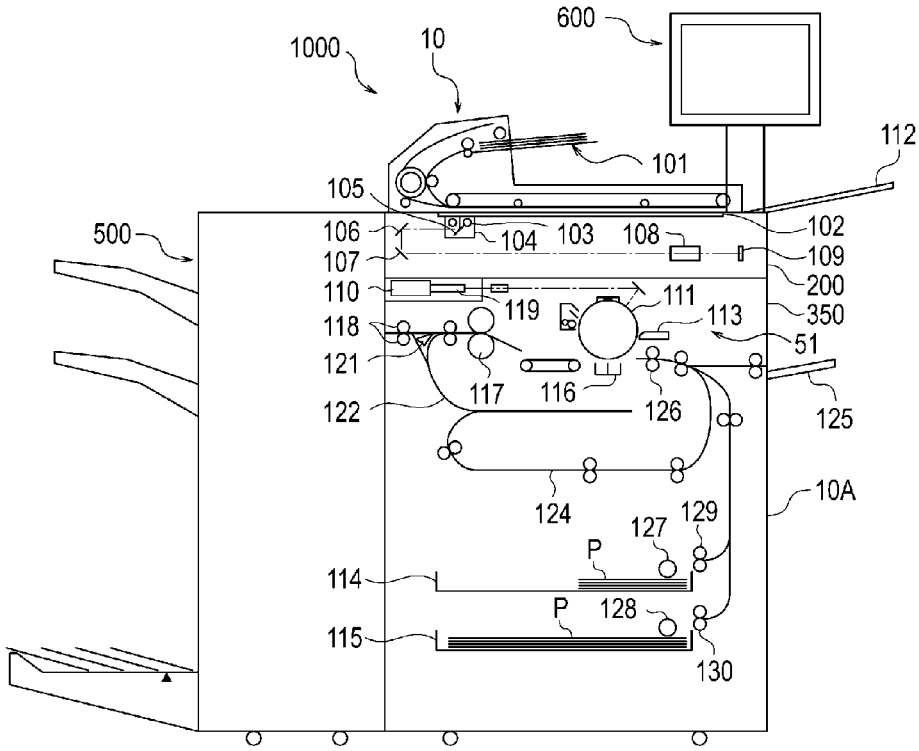
FIG. 1 is a sectional view illustrating a configuration of an image forming system provided with a sheet processing apparatus according to an embodiment of the invention.

FIG. 1 is a sectional view illustrating a configuration of an image forming system 1000 provided with a sheet processing apparatus according to an embodiment of the invention. The image forming system 1000 includes an image forming apparatus 10 in which an electrophotographic image forming process is utilized and a finisher 500 that is the "sheet processing apparatus". As illustrated in FIG. 1, the image forming apparatus 10 includes an image forming apparatus main body (hereinafter referred to as apparatus main body 10A). An image forming portion 51 that forms an image is provided in the apparatus main body 10A. The image forming portion 51 includes a photosensitive drum 111 that is the "image bearing member" and a transfer device 116. At least the photosensitive drum 111 is included in a process cartridge, and the process cartridge may be configured to be incorporated in the apparatus main body 10A. The image forming apparatus 10 includes an image reader 200 that reads the image from an original and a printer 350 that forms the image on a sheet P.

An original feeding device 100 feeds the original set upward on an original tray 101 in the left direction of FIG. 1 in one-on-one manner from a front page, conveys the original on a platen glass 102 from the left to the right through a curved path and a predetermined flow scan read position, and discharge the original toward a discharge tray 112.

The flow scan read position means a predetermined read position of the platen glass 102 included in the image reader 200, and a scanner unit 104 is fixed in the flow scan read position. When the original passes by the flow scan read position on the platen glass 102 from the left toward the right, the original image is read by the scanner unit 104 retained at the position corresponding to the flow scan read position.

When the original passes by the flow scan read position, a read surface of the original is irradiated with light emitted from a lamp 103 of the scanner unit 104, and light reflected from the original is guided to a lens 108 through mirrors 105, 106, and 107. The image of the light passing through the lens 108 is formed on an imaging surface of an image sensor 109.

The original is conveyed so as to pass by the flow scan read position from the left toward the right, thereby performing original read scanning. When the original passes by the flow scan read position, the original is conveyed in a sub-scanning direction while the original image is read in each line by the image sensor 109 in a main scanning direction, thereby reading the whole of original image. As used herein, the main scanning direction means a direction orthogonal to the original conveying direction, and the sub-scanning direction means the original conveying direction. The optically read image is output by the image sensor 109 while converted into image data. The image data output from the image sensor 109 is input as a video signal to an exposure portion 110 of the printer 350.

Alternatively, the original is conveyed onto the platen glass 102 by the original feeding device 100 and stopped at a predetermined position, and the original may be read by scanning the scanner unit 104 from the left to the right. The reading method is called original fixed read.

When the original is read with no use of the original feeding device 100, a user holds up the original feeding device 100 to place the original on the platen glass 102. The scanner unit 104 is scanned from the left to the right to read the original. The original fixed read is performed when the original is read with no use of the original feeding device 100.

The exposure portion 110 of the printer 350 modulates and outputs a laser beam based on the video signal input from the image reader 200. The photosensitive drum 111 is irradiated with the laser beam while the laser beam is scanned by a polygon mirror 119. An electrostatic latent image is formed on the photosensitive drum 111 according to the scanned laser beam. During the original fixed read, the exposure portion 110 outputs the laser beam so as to form a correct image (not mirror image). The electrostatic latent image on the photosensitive drum 111 is visualized as a developer image using a developer supplied from a development device 113.

On the other hand, the sheet P fed from an upper cassette 114 or a lower cassette 115, provided in the printer 350, by a pickup roller 127 or 128 is conveyed to a registration roller 126 by a feeding roller 129 or 130. When a leading end of the sheet P reaches the registration roller 126, the registration roller 126 is driven in arbitrary timing, and the sheet P is conveyed between the photosensitive drum 111 and a transfer device 116 in synchronization with the start of the laser beam irradiation. The developer image formed on the photosensitive drum 111 is transferred onto the fed sheet P by the transfer device 116. The sheet P to which the developer image is transferred is conveyed to a fixing portion 117, and the fixing portion 117 fixes the developer image onto the sheet P by heating and pressurizing the sheet P. The sheet P passing through the fixing portion 117 is discharged from the printer 350 toward the outside of the image forming apparatus (in this case, toward the finisher 500) through a switching member (flapper) 121 and a discharge roller 118.

At this point, when the sheet P is discharged while the image forming surface of the sheet P is oriented downward (face-down), the sheet P passing through the fixing portion 117 is tentatively guided to an inverting path 122 by a switching operation of the switching member (flapper) 121. After a tailing end of the sheet P passes through the switching member (flapper) 121, the sheet P is switched back and discharged from the printer 350 by the discharge roller 118. The discharge mode is called inversion discharge. The inversion discharge is performed when the images are sequentially formed from a front page such that when the images read by the original feeding device 100 are formed or such that the images output from a computer are formed, the sequence of the discharged sheets P becomes correct.

When the hard sheet P such as an OHP sheet is fed from a manual feeding portion 125 to form the image in the sheet P, the sheet P is discharged by the discharge roller 118 without guiding the sheet P to the inverting path 122 while the image forming surface is oriented upward (face-up). When double-sided recording in which the images are formed on both surfaces of the sheet P is set, the sheet P is conveyed to a duplex conveying path 124 after being guided to the inverting path 122 by the switching operation of the switching member (flapper) 121. Then the sheet P guided to the duplex conveying path 124 is fed between the photosensitive drum 111 and the transfer device 116 again in the above-described timing.

Figure 2:
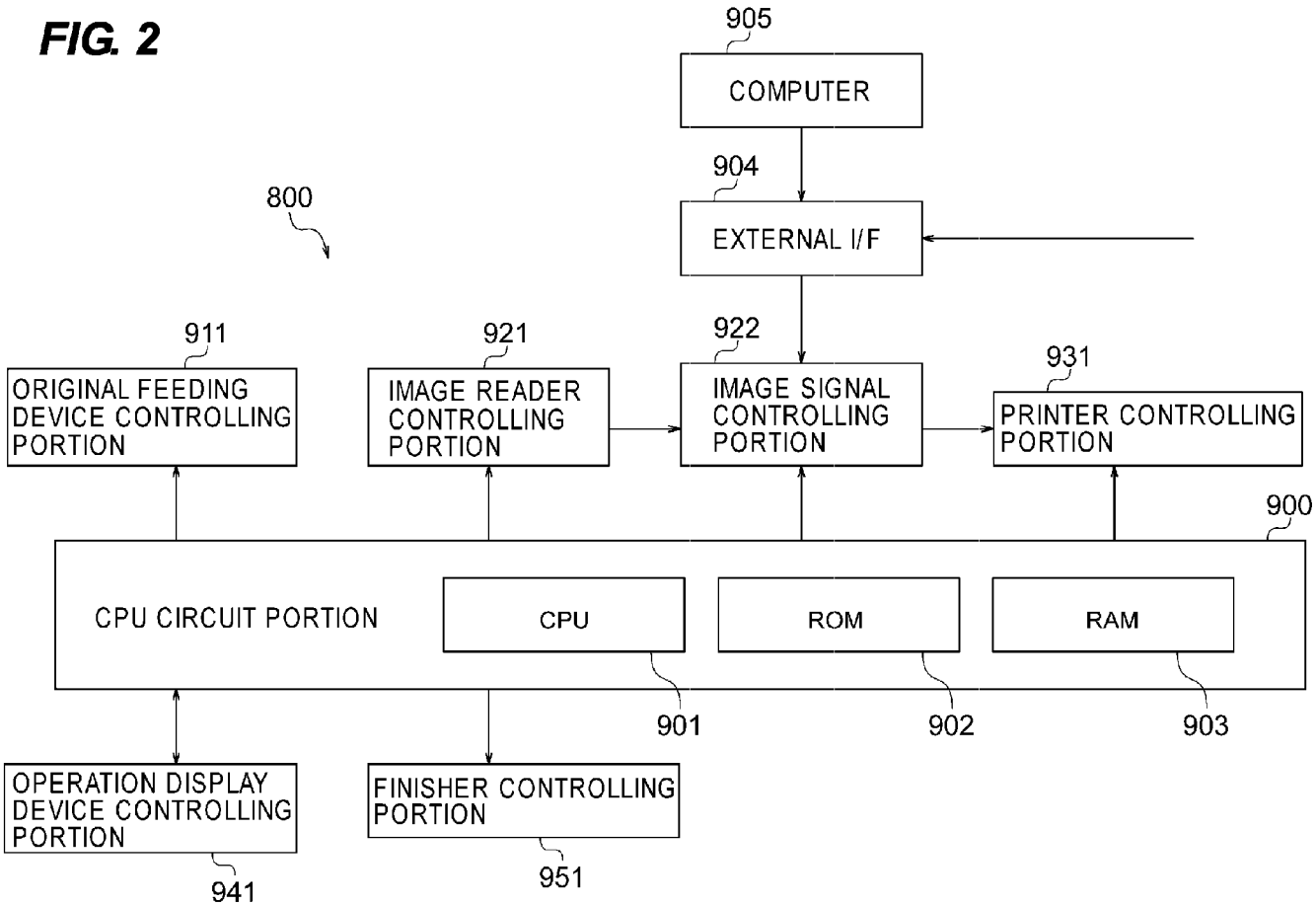
FIG. 2 is a block diagram illustrating a controller of an image forming system.

FIG. 2 is a block diagram illustrating a controller 800 of the image forming system 1000. As illustrated in FIG. 2, the controller 800 provided in the image forming apparatus 10 includes a CPU circuit portion 900. The CPU circuit portion 900 includes a CPU 901, a ROM 902, and a RAM 903. The CPU 901 performs basic control of the whole of image forming system, and the ROM 902 in which a control program is written and the RAM 903 that is used to perform processing are connected to the CPU 901 through an address bus and data bus. The CPU 901 totally controls controlling portions 911, 921, 922, 904, 931, 941, and 951 using the control program stored in the ROM 902. Control data is tentatively stored in the RAM 903, and the RAM 903 is used as a work area for computing processing associated with the control.

The original feeding device controlling portion 911 controls the original feeding device 100 in response to an instruction from the CPU circuit portion 900. The image reader controlling portion 921 controls the scanner unit 104 and the image sensor 109 and transfers an analog image signal output from the image sensor 109 to the image signal controlling portion 922.

The image signal controlling portion 922 performs various pieces of processing after converting the analog image signal from the image sensor 109 into a digital signal and converts the digital signal into the video signal and outputs the video signal to the printer controlling portion 931. The image signal controlling portion 922 performs various pieces of processing to a digital image signal input through an external interface 904 from a computer 905 and converts the digital image signal into the video signal and outputs the video signal to the printer controlling portion 931. The processing operation of the image signal controlling portion 922 is controlled by the CPU circuit portion 900. The printer controlling portion 931 controls the exposure portion 110 based on the input video signal.

The finisher controlling portion 951 that is the "controller" is incorporated in the finisher 500 and controls the finisher 500 by transmitting and receiving information to and from the CPU circuit portion 900. Contents of the finisher controlling portion 951 are described below. In the embodiment, the finisher controlling portion 951 controls the finisher 500. Alternatively, the controller 800 provided in the image forming apparatus 10 may directly control the finisher 500.

The operation display device controlling portion 941 transmits and receives information to and from an operation display device 600 and the CPU circuit portion 900. The operation display device 600 includes plural keys that are used to set various functions relating to the image formation and a display portion that displays information indicating a setting state. The operation display device 600 (see FIG. 1) outputs a key signal corresponding to an operation of each key to the CPU circuit portion 900 and displays the corresponding information on the screen based on a signal from the CPU circuit portion 900.

Figure 3:
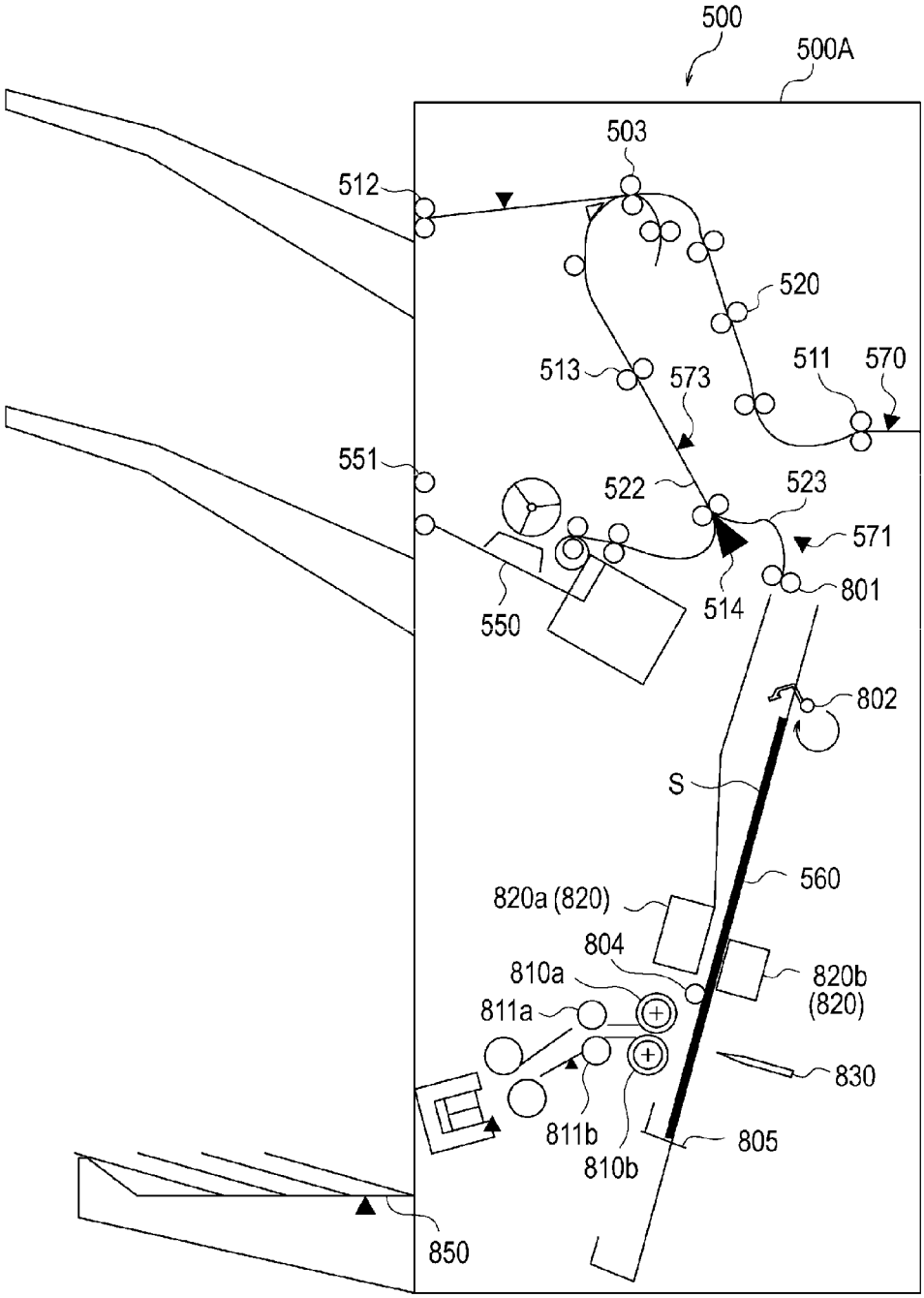
FIG. 3 is a sectional view illustrating a configuration of a finisher.

FIG. 3 is a sectional view illustrating a configuration of the finisher 500. As illustrated in FIG. 3, the finisher 500 sequentially takes in the sheet P discharged from the image forming apparatus 10 and performs a sheet post-process of aligning the taken-in plural sheets P to form a bundle of the sheets P. The finisher 500 performs various sheet post-processes such as a staple process of stapling a tailing end of a sheet bundle S, a sort process, a non-sort process, and a bookbinding process.

The finisher 500 takes in the sheet P discharged from the image forming apparatus 10 by a pair of inlet rollers 511, and the sheet P taken in by the pair of inlet rollers 511 is delivered through a pair of conveying rollers 520, a pair of buffer rollers 503, and a pair of conveying rollers 513.

A switching member (flapper) 514 is disposed downstream of a discharge path 522 to switch between a processing tray 550 and a bookbinding path 523.

The sheet P guided to the bookbinding path 523 is conveyed to a bookbinding intermediate processing tray (hereinafter referred to as an intermediate tray) 560 through a pair of conveying rollers 801. The pair of conveying rollers 801 that is the "conveying portion" conveys the sheet P in a sheet conveying direction M. The intermediate tray 560 that is the "collecting portion" collects the sheets P conveyed by the pair of conveying rollers 801 to form the sheet bundle S. A bookbinding inlet sensor 571 is provided in the middle of the bookbinding path 523.

A sheet gripping member 802 and a movable sheet positioning member 805 are provided in the intermediate tray 560. The sheet gripping member 802 that is the "one end gripping member" can grip one end in the conveying direction M (upper end in FIG. 3) of the sheet bundle S stacked on the intermediate tray 560. The positioning member 805 that is the "other-end gripping member" can grip the other end in the conveying direction M (lower end in FIG. 3) of the sheet bundle S stacked on the intermediate tray 560. As described below, the sheet gripping member 802 is moved by driving a sheet gripping member moving motor M12 that is the "moving portion", and the positioning member 805 is moved by driving a positioning member moving motor M14 that is the "moving portion". Both the sheet gripping member moving motor M12 and the positioning member moving motor M14, which are the "moving portions", are driven to move the sheet gripping member 802 and the positioning member 805 in a direction in which the sheet gripping member 802 and the positioning member 805 come close each other. Both the sheet gripping member moving motor M12 and the positioning member moving motor M14 are reversely driven to move the sheet gripping member 802 and the positioning member 805 in a direction in which the sheet gripping member 802 and the positioning member 805 are separated from each other.

An anvil 820*b* is provided opposite a stapler 820*a*, and the stapler 820*a* and the anvil 820*b* perform the staple process to the sheet bundle S stored in the intermediate tray 560 in conjunction with each other. The stapler 820*a* and the anvil 820*b* constitute a main part of a staple device 820.

A pair of folding rollers 810*a* and 810*b* and an projecting member 830 that is disposed opposite the pair of folding rollers 810*a* and 810*b* are provided below the stapler 820*a*. The projecting member 830 is disposed on a first surface side of the sheet bundle S, and a leading end of the projecting member 830 extended in parallel with a sheet width direction N orthogonal to the sheet conveying direction M project toward the sheet bundle S. The projecting member 830 projects a part between the one end and the other end of the sheet bundle S gripped by the sheet gripping member 802 and the positioning member 805 toward the pair of folding rollers 810*a* and 810*b*. The pair of folding rollers 810*a* and 810*b* that is the "pair of rollers" is disposed on a second surface side of the sheet bundle S. The folding rollers 810*a* and 810*b* face each other while each of the folding rollers 810*a* and 810*b* includes a rotation center extended in parallel with the sheet width direction N, and the folding rollers 810*a* and 810*b* receive and convey the sheet bundle S that is folded by the projection of the projecting member 830. The pair of folding rollers 810*a* and 810*b* conveys the sheet bundle S while nipping the sheet bundle S therebetween, thereby folding the sheet bundle S.

The sheet bundle S stored in a bundle manner in the intermediate tray 560 is pushed between the folding rollers 810*a* and 810*b* by projecting the projecting member 830 toward the sheet bundle S. The folded sheet bundle S is transferred to a pair of folding rollers 811*a* and 811*b* through the folding rollers 810*a* and 810*b* and discharged to the bookbinding tray 850.

As described above, the sheet gripping member moving motor M12 and the positioning member moving motor M14 are driven in synchronization with the operation in which the projecting member 830 is projected toward the sheet bundle S while the sheet bundle S is gripped by the sheet gripping member 802 and the positioning member 805. Therefore, the sheet gripping member 802 and the positioning member 805 are brought close to each other.

Figure 4:
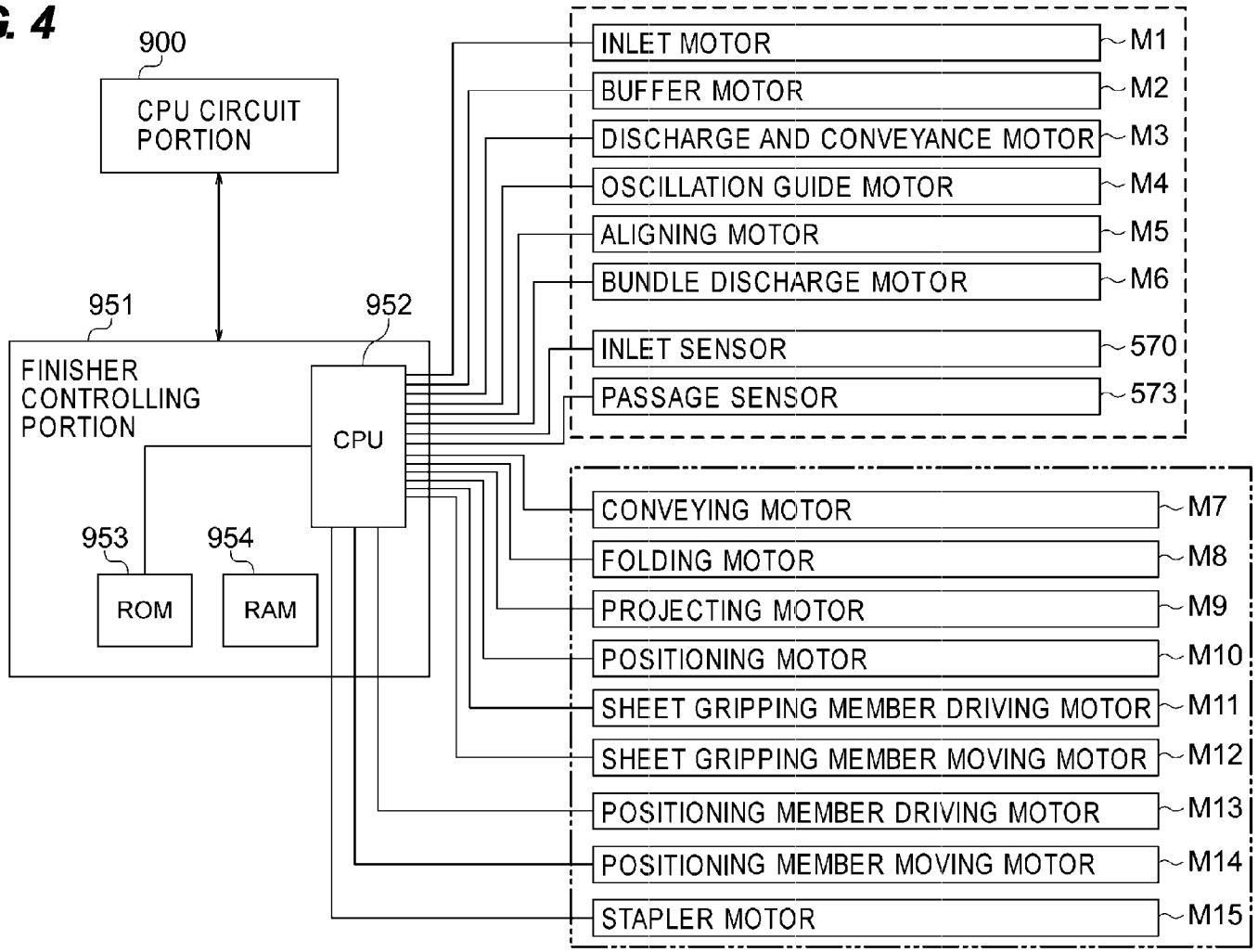
FIG. 4 is a block diagram illustrating a connection state of a finisher controlling portion that controls the finisher and internal devices of the finisher.

FIG. 4 is a block diagram illustrating a connection state of the finisher controlling portion 951 that controls the finisher 500 and internal devices of the finisher 500. The finisher controlling portion 951 of FIG. 4 corresponds to the finisher controlling portion 951 of FIG. 2.

As illustrated in FIG. 4, the finisher controlling portion 951 includes a CPU 952, a ROM 953, and a RAM 954. The finisher controlling portion 951 performs data exchange by conducting communication with the CPU circuit portion 900 provided on the side of the apparatus main body 10A through a communication interface (not illustrated), and the finisher controlling portion 951 executes various programs stored in the ROM 953 based on an instruction from the CPU circuit portion 900, thereby controlling the finisher 500.

As to various inputs and outputs, an inlet motor M1 is provided to drive the pair of inlet rolls 511 and the pair of conveying rollers 520, a buffer motor M2 is provided to drive the pair of buffer rollers 503, and a discharge and conveyance motor M3 is provided to drive a pair of discharge rollers 512 and the pair of conveying rollers 513. A bundle discharge motor M6 that drives a bundle discharge roller 551, an oscillation guide motor M4 that lifts and lowers an oscillation guide (not illustrated), and an aligning motor M5 that drives an aligning member (not illustrated) are provided in order to drive various members of the processing tray 550. Additionally, an inlet sensor 570 and a passage sensor 573 are provided to sense the passage of the sheet P.

As to inputs and outputs for the bookbinding function, a conveying motor M7 is provided to drive the pair of conveying rollers 801, a folding motor M8 is provided to drive the pair of folding rollers 810*a* and 810*b*, and a projecting motor M9 is provided to drive the projecting member 830. A positioning motor M10 is provided to separate and abut the sheet positioning member 804 from and on the intermediate tray 560.

A sheet gripping member driving motor M11 that is the "grip driving portion" is provided to drive the sheet gripping member 802 such that the sheet bundle S of the bookbinding target is gripped by the sheet gripping member 802. The sheet gripping member moving motor M12 that is the "moving portion" moving the sheet gripping member 802 is provided as the "sheet gripping member moving portion".

A positioning member driving motor M13 that is the "grip driving portion" is provided to drive the positioning member 805 such that the sheet bundle S of the bookbinding target is gripped by the positioning member 805. The positioning member moving motor M14 that is the "moving portion" moving the positioning member 805 is provided as the "positioning member moving portion". A stapler motor M15 is provided to drive the stapler 820*a*.

The CPU 952 that is the controller controls such that the sheet gripping member moving motor M12 and the positioning member moving motor M14 are driven to move the sheet gripping member 802 and the positioning member 805 based on sheet information. For example, the CPU 952 controls to move the sheet gripping member 802 and the positioning member 805 based on sheet information that the sheet bundle S stacked on the intermediate tray 560 is a target of a non-binding process in which the binding process is not specified. Therefore, the sheets P constituting the sheet bundle S are prevented from loosening, when the sheet bundle S is projected toward the pair of folding rollers 810*a* and 810*b* by the projecting member 830 while the sheet bundle S to be folded is not bound.

The CPU 952 controls the sheet gripping member 802 and the positioning member 805 based on sheet information that the sheets P constituting the sheet bundle S to be folded is a rigid sheet such as a thick paper having a large basis weight or a small-size sheet. Therefore, the sheet bundle S is projected toward the pair of folding rollers 810*a* and 810*b* by the projecting member 830, and the sheets P are prevented from loosening by a restoring force of rigidity of the sheet P when sheet ends drop off from the sheet gripping member 802 and the positioning member 805.

The CPU 952 controls to move the sheet gripping member 802 and the positioning member 805 based on sheet information that the number of sheets of the sheet bundle S stacked on the intermediate tray 560 is a predetermined number or more. When the number of sheets of the sheet bundle S stacked on the intermediate tray 560 is a predetermined number or more, the rigidity of the whole sheet bundle S increases. Therefore, the sheet bundle S is projected by the projecting member 830, and the sheets P are prevented from loosening by the restoring force of the rigidity of the sheet bundle S when sheet ends drop off from the sheet gripping member 802 and the positioning member 805.

The CPU 952 causes the sheet gripping member 802 and the positioning member 805 to finish gripping the sheet bundle S when the sheet bundle S travels a predetermined distance while being nipped between the pair of folding rollers 810*a* and 810*b*. The CPU 952 separates the sheet gripping member 802, the positioning member 805, and the projecting member 830 from the sheet bundle S.

Figure 5A:
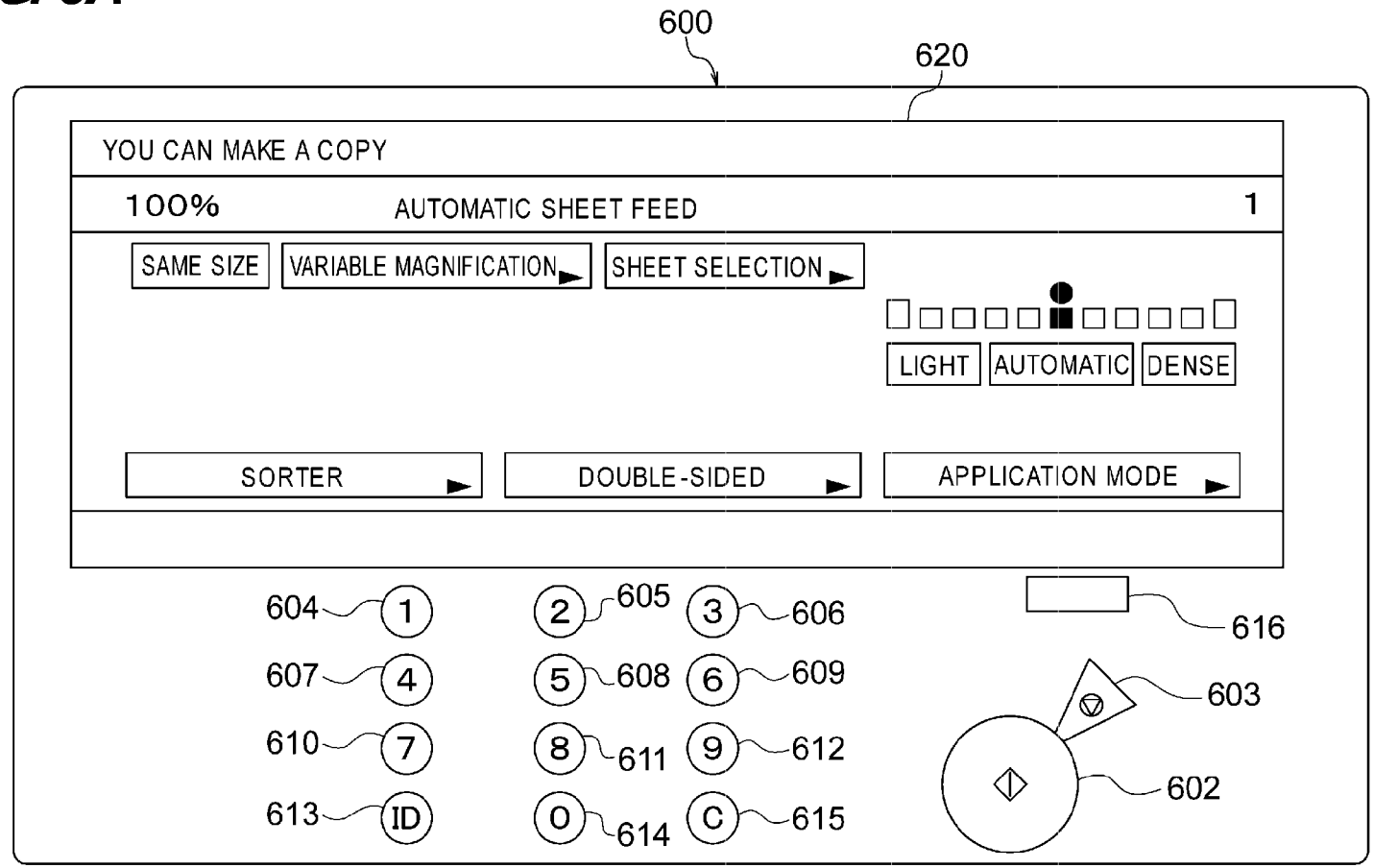
FIG. 5A is a plan view illustrating a configuration of an operation display device.

FIG. 5A is a plan view illustrating a configuration of the operation display device 600. As illustrated in FIG. 5A, the operation display device 600 includes a start key 602 that is used to start the image forming operation, a stop key 603 that is used to stop the image forming operation, numerical keys 604 to 612 and 614 that are used to set numerical value, and an ID key 613. The operation display device 600 also includes a clear key 615 and a reset key 616. A display portion 620 in which a touch panel is formed is disposed in an upper part of the operation display device 600. A softkey can be produced on the screen.

For example, the image forming system 1000 has various process modes such as a non-sort process mode, a sort process mode, and a bookbinding mode as the post-process mode of the finisher 500. The process modes are set by an input operation using the operation display device 600.

Figure 5B:
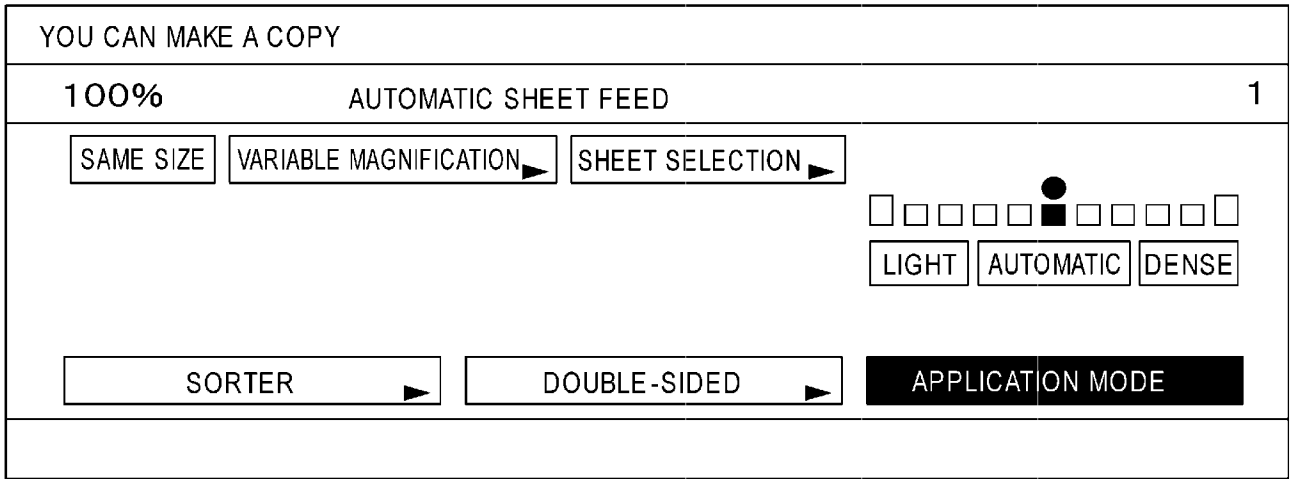
FIG. 5B is a plan view illustrating an initial screen of a display portion of the operation display device.
Figure 5C:
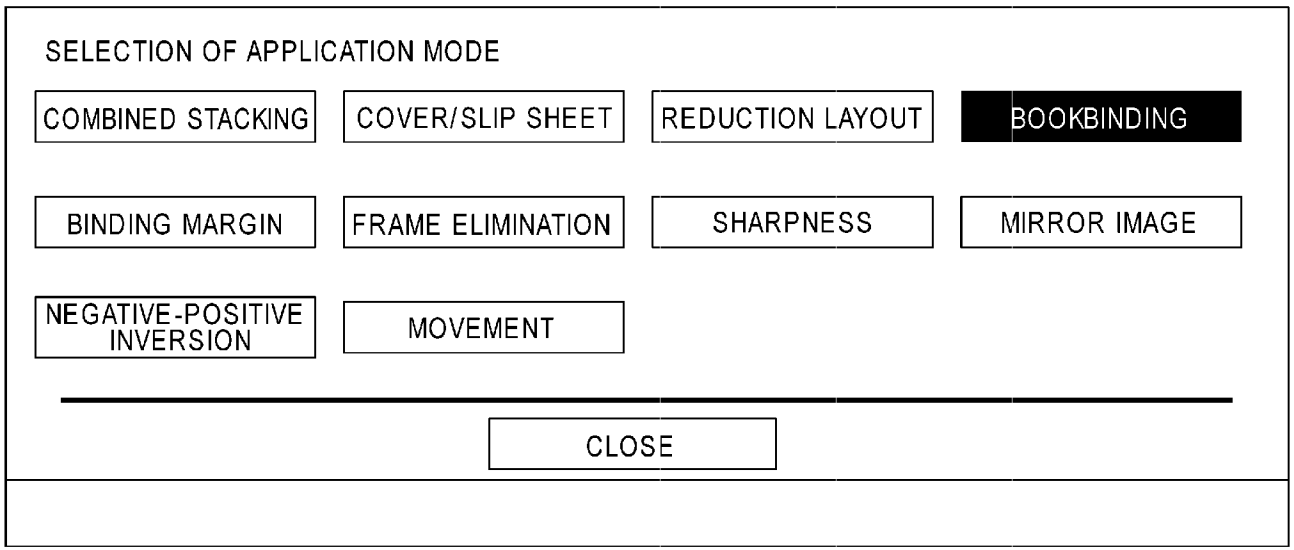
FIG. 5C is a plan view illustrating an application mode selection screen displayed on the display portion of the operation display device.
Figure 6A:
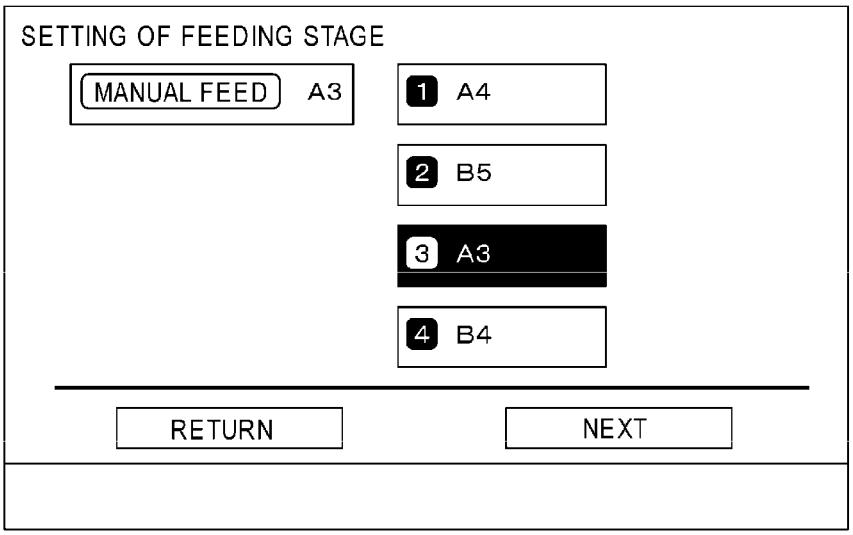
FIG. 6A is a plan view illustrating a feeding stage setting screen displayed on the display portion of the operation display device.
Figure 6B:
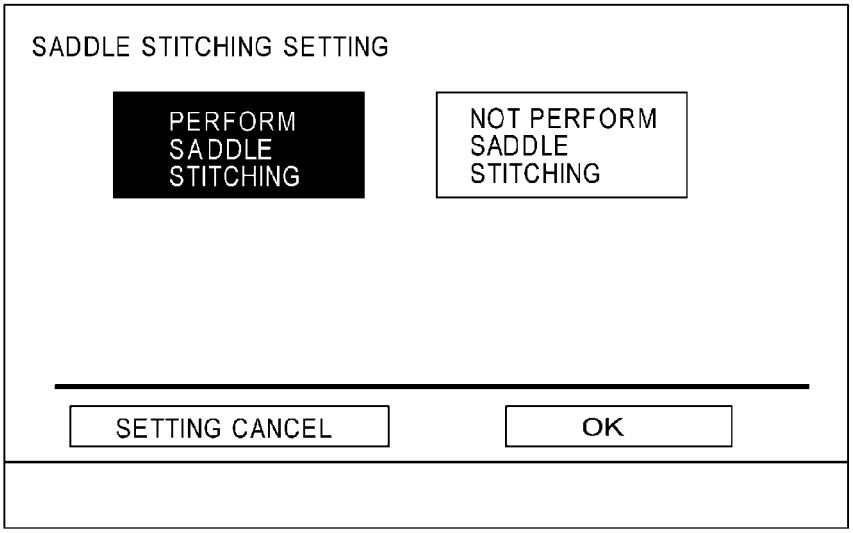
FIG. 6B is a plan view illustrating a saddle stitching setting screen displayed on the display portion of the operation display device.

FIG. 5B is a plan view illustrating an initial screen of the display portion 620 of the operation display device 600. FIG. 5C is a plan view illustrating an application mode selection screen displayed on the display portion 620 of the operation display device 600. FIG. 6A is a plan view illustrating a feeding stage setting screen displayed on the display portion 620 of the operation display device 600. FIG. 6B is a plan view illustrating a saddle stitching setting screen displayed on the display portion 620 of the operation display device 600.

Figure 7:
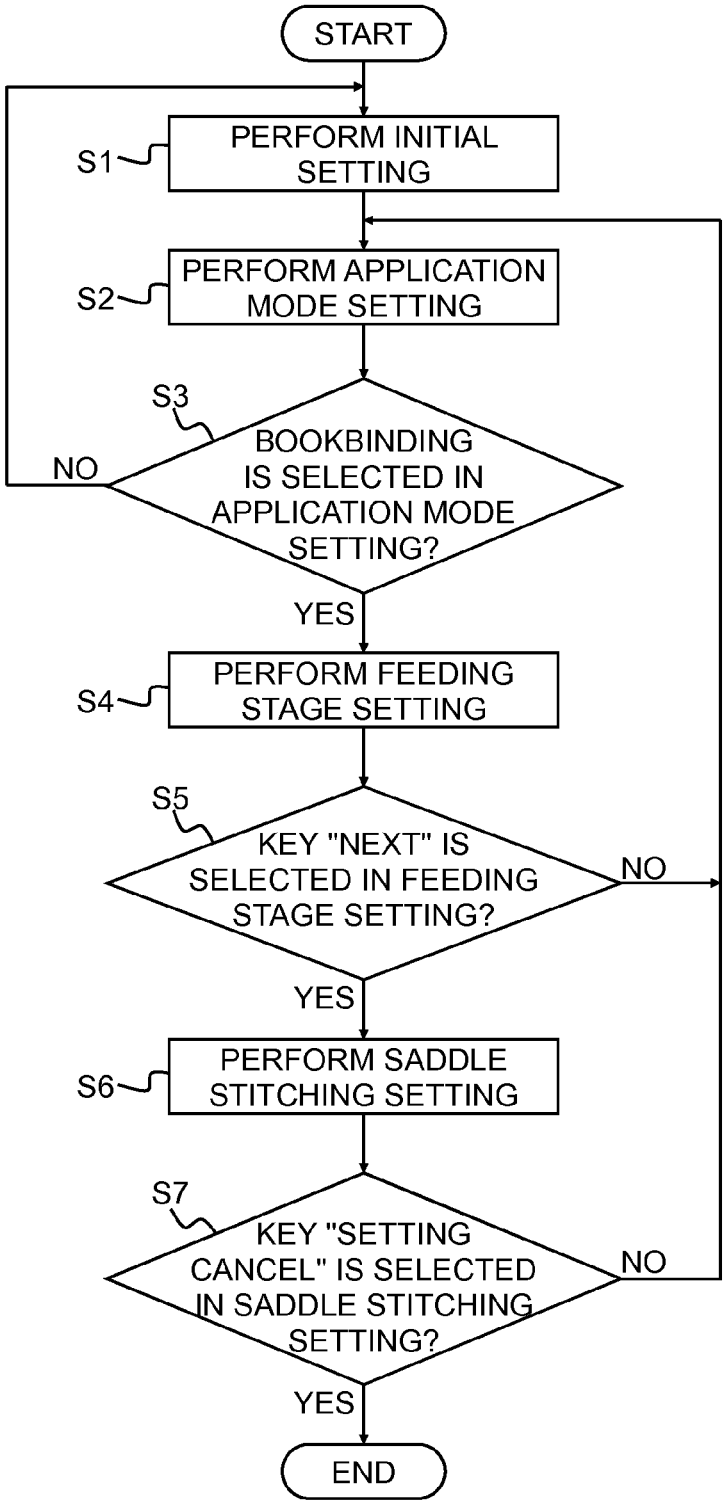
FIG. 7 is a flowchart illustrating a controlling process performed by a CPU.
Figure 8:
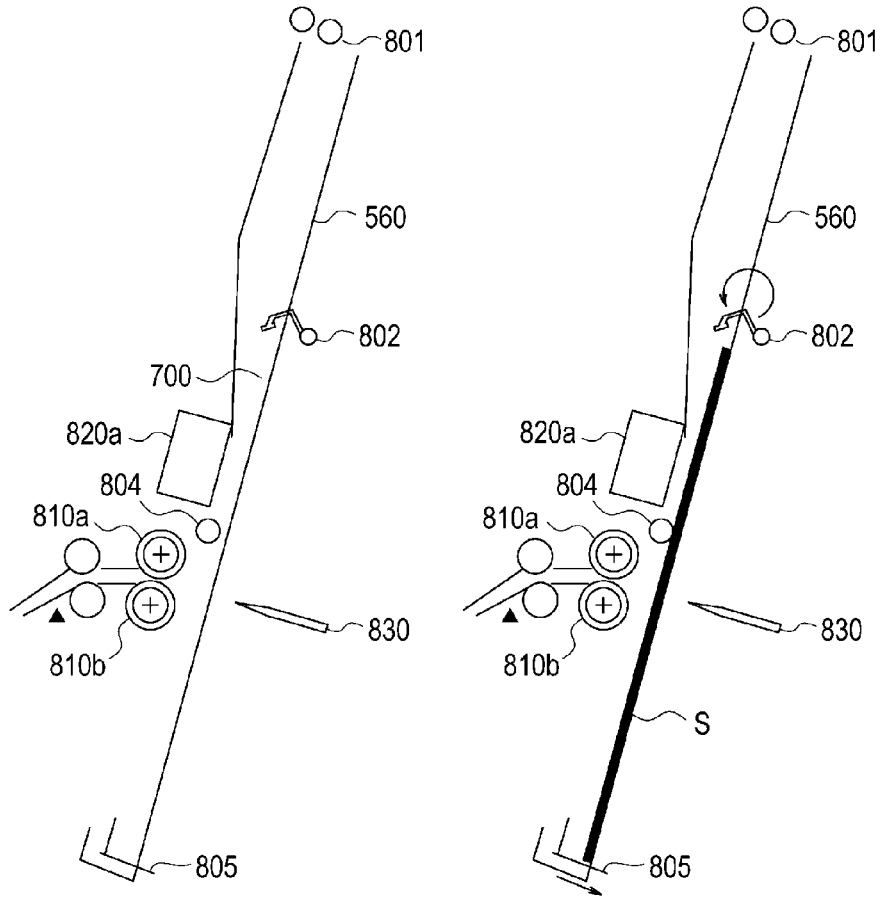
FIG. 8 is a partially enlarged sectional view illustrating a finisher controlling process.
Figure 9:
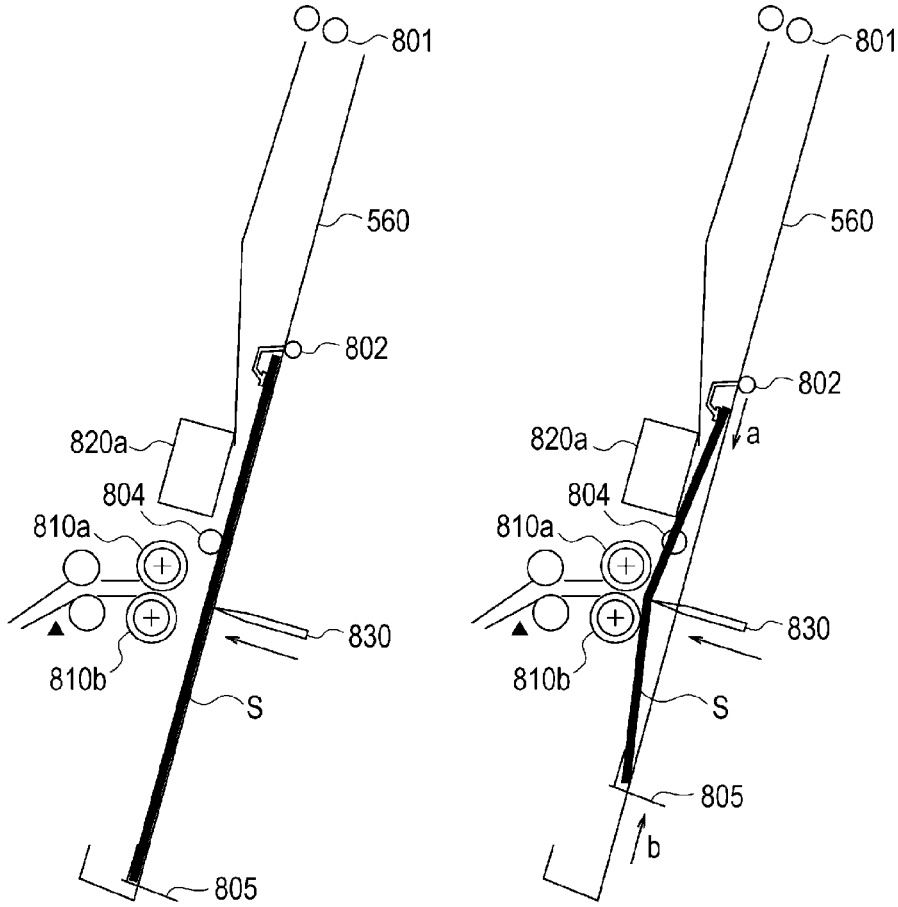
FIG. 9 is a partially enlarged sectional view illustrating a finisher controlling process.
Figure 10:
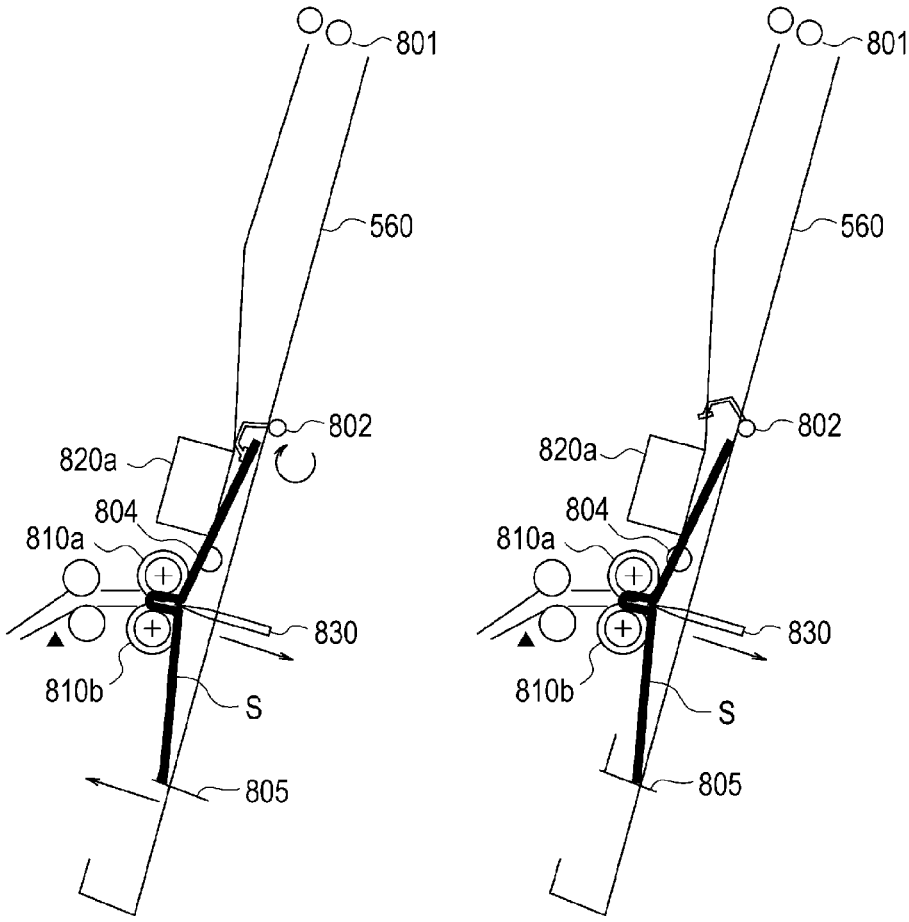
FIG. 10 is a partially enlarged sectional view illustrating a finisher controlling process.

FIG. 7 is a flowchart illustrating a controlling process performed by the CPU 952. The CPU 952 performs an initial setting based on a pressing signal that is generated when a user presses the reset key 616 (S1). When the user presses an "application mode" key in the softkeys of the initial screen (see FIG. 5B) displayed on the display portion 620 (see FIG. 5A), the CPU 952 causes the display portion 620 to transition to the application mode selection screen (see FIG. 5C).

On the application mode selection screen, the user performs various settings in the application mode (S2). For example, the user presses a "bookbinding" key in the softkeys of the application mode selection screen (see FIG. 5C) displayed on the display portion 620 (see FIG. 5A) (S2).

The CPU 952 determines whether the bookbinding is selected in the application mode setting (S3). When the "bookbinding" key is pressed (YES in S3), the CPU 952 causes the application mode selection screen (see FIG. 5C) to transition to the feeding stage setting screen (see FIG. 6A). When a "close" key is pressed (NO in S3), the CPU 952 returns to S1 and the display portion 620 transitions to the initial screen.

On the feeding stage setting screen (see FIG. 6A), the user selects one of the feeding stages (S4). For example, the user presses an "A3" key in the softkeys of the feeding stage setting screen (see FIG. 6A) displayed on the display portion 620 (see FIG. 5A) (S4).

The CPU 952 determines whether the user selects a "next" key after setting one of the feeding stages on the feeding stage setting screen (S5). When the "next" key is pressed (YES in S5), the CPU 952 causes the display portion 620 to transition to a saddle stitching setting screen (see FIG. 6B). When a "return" key is pressed (NO in S5), the CPU 952 causes the display portion 620 to transition to the application mode selection screen (see FIG. 5C) (S2).

On the saddle stitching setting screen (see FIG. 6B), the user selects the presence or absence of the saddle stitching setting, and the CPU 952 selects the presence or absence of the saddle stitching setting based on a selection signal of the saddle stitching setting from the user (S6). For the saddle stitching bookbinding, the user selects a "perform saddle stitching" key. For the non-bound bookbinding, the user selects a "not perform saddle stitching" key.

The CPU 952 determines whether a "setting cancel" key is selected in the saddle stitching setting (S7). When the user selects an "OK" key after selecting one of the "perform saddle stitching" key and the "not perform saddle stitching" key (NO in S7), the CPU 952 causes the display portion 620 to transition to the initial screen (see FIG. 5B) (S2). When the user selects the "setting cancel" key (YES in S7), the CPU 952 causes the display portion 620 to transition to the application mode selection screen (see FIG. 5C).

Figure 13:
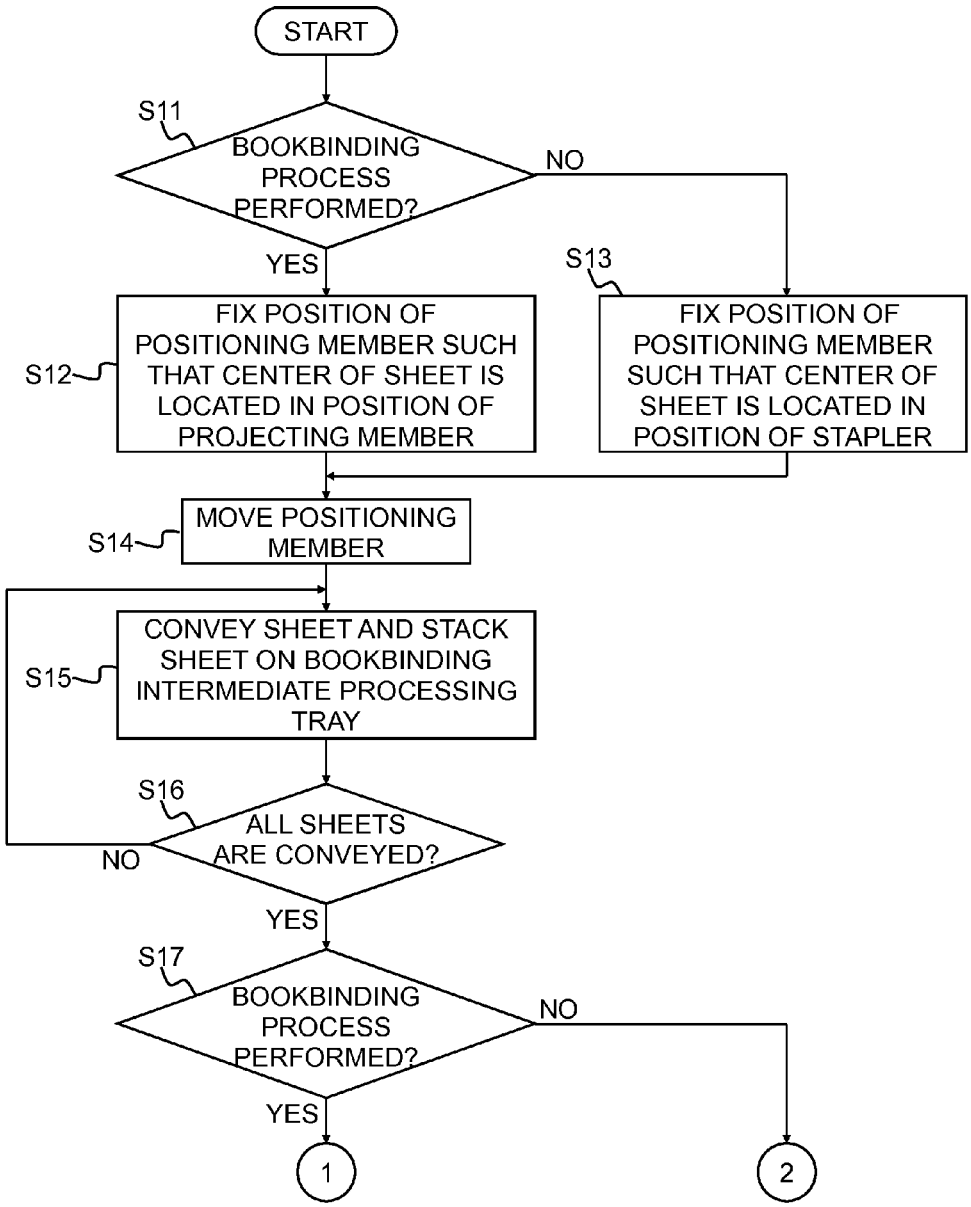
FIG. 13 is a flowchart illustrating a controlling process performed by a CPU.
Figure 14:
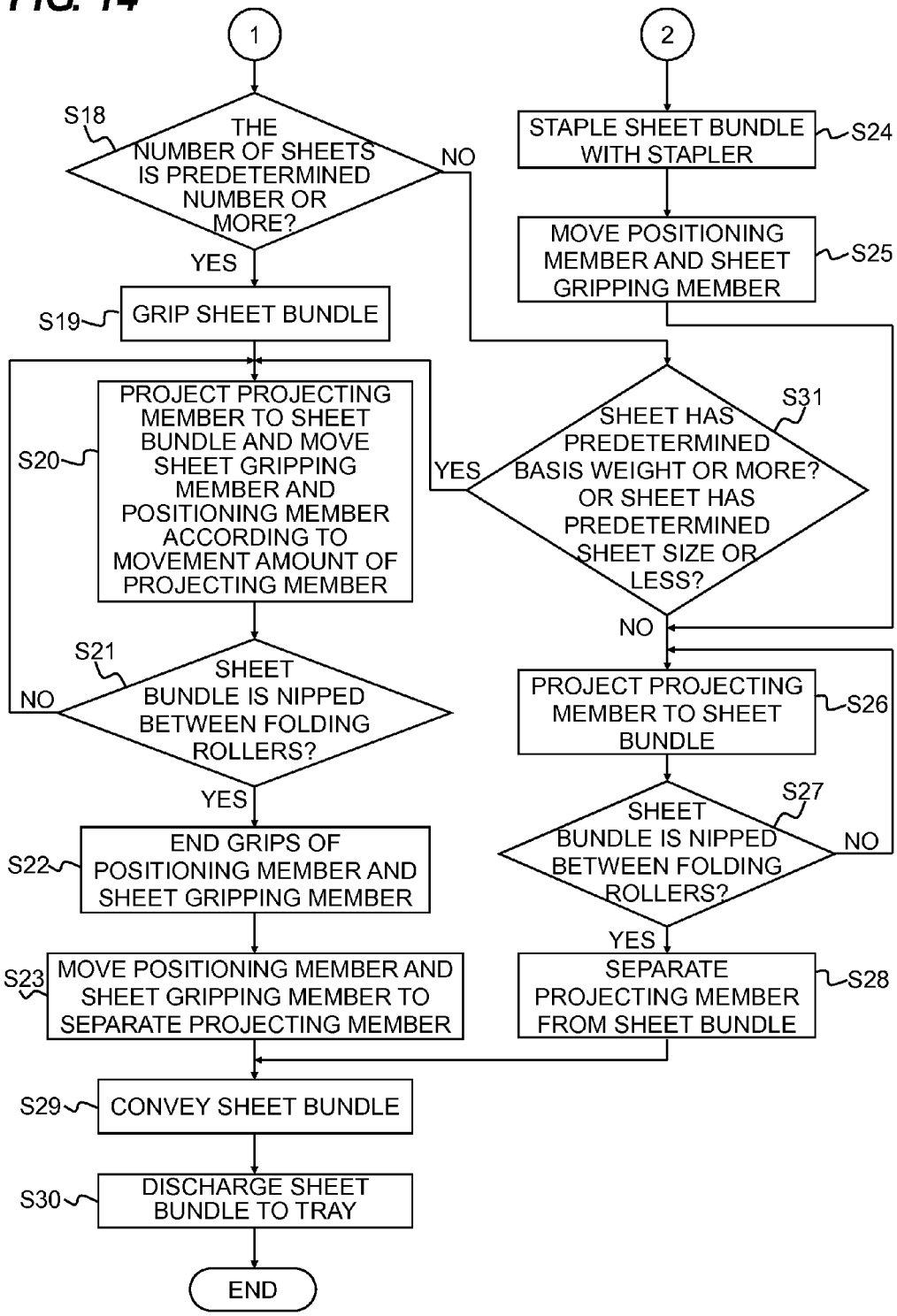
FIG. 14 is a flowchart illustrating a controlling process performed by a CPU.

FIGS. 8 to 12 are partially enlarged sectional views illustrating a process of controlling the finisher 500. FIGS. 13 and 14 are flowcharts illustrating a controlling process performed by the CPU 952 of the finisher 500. An operation in the bookbinding mode will be described below with reference to FIGS. 13 and 14 and, in some cases, FIGS. 8 to 12. The bookbinding process is started when the user presses the start key 602. In the embodiment, the sheet bundle S is projected and folded while gripped, when the number of sheets of the sheet bundle S that becomes the bookbinding target is a predetermined number or more in the non-binding process. Alternatively, in order to more securely perform the folding process to the non-bound sheet bundle S, the sheet bundle S may be projected and folded while gripped, when the number of sheets of the sheet bundle S that becomes the bookbinding target is a predetermined number or less in the non-binding process. The invention can also be applied to the sheet bundle of any folding process target irrespective of the binding process or irrespective of the number of sheets constituting the sheet bundle.

(From Operation of Operation Portion to Start of Conveyance)

In the operation display device 600, the user specifies sheet information (for example, basis weight, sheet size, plain paper, the number of sheets, and sheet type such as coated paper) on the sheet constituting the sheet bundle to be processed and the bookbinding mode. When the start key 602 (see FIG. 5A) is pressed, the CPU 952 determines whether the binding process is performed (binding process or non-binding process) based on the information on the sheet P of the bookbinding target (S11). As used herein, the sheets P of the bookbinding target means the bookbinding target sheets that are conveyed from the image forming apparatus 10 to the finisher 500.

When the information on the sheets P of the bookbinding target is the non-binding process (YES in S11), the CPU 952 fixes the position of the positioning member 805 such that a central part of the sheets P are located at the position of the projecting member 830, and the CPU 952 stores the information on the position of the positioning member 805 in the RAM 954 (S12).

When the information on the sheets P of the bookbinding target is the binding process (NO in S11), the CPU 952 fixes the position of the positioning member 805 such that the central part of the sheets P are located at the position of the stapler 820*a*, and the CPU 952 stores the information on the position of the positioning member 805 in the RAM 954 (S13).

After S12 or S13, the CPU 952 drives the positioning member moving motor M14 to move the positioning member 805 based on the information on position of the positioning member 805 stored in the RAM 954 (S14).

(In the Case in which the Number of Sheets P of Bookbinding Target is Predetermined Number or More in Non-Binding Process)

The sheet P of the bookbinding target is conveyed from the image forming apparatus 10 to the finisher 500. The CPU 952 drives the inlet motor M1, the buffer motor M2, the discharge and conveyance motor M3, and the conveying motor M7 to rotate the pair of inlet rollers 511, the pair of conveying rollers 520, the pair of buffer rollers 503, the pair of conveying rollers 513, the pair of conveying rollers 801. As illustrated in FIG. 8A, the sheet P of the bookbinding target is conveyed and stacked on the intermediate tray 560 (S15). At this point, the switching member (flapper) 514 is retained while the sheet P of the bookbinding target is guided to the bookbinding path 523 by a solenoid (not illustrated).

The CPU 952 determines whether all the sheets P of the bookbinding targets are conveyed (S16). When all the sheets P of the bookbinding targets are conveyed (YES in S16), the CPU 952 determines whether the non-binding process is performed to the sheets P of the bookbinding target (S17). When all the sheets P of the bookbinding targets are not conveyed (NO in S16), the CPU 952 returns to S15.

When the non-binding process are performed to the sheets P of the bookbinding target (YES in S17), the CPU 952 determines whether the number of sheets P of the bookbinding targets stacked on the intermediate tray 560 is a predetermined number or more (see S18 of FIG. 14). When the non-binding process are not performed to the sheets P of the bookbinding target (NO in S17), the CPU 952 causes the stapler to staple the sheet bundle S including the plural sheets P (see S24 of FIG. 14).

FIG. 14 is a flowchart illustrating a controlling process performed by the CPU 952. As illustrated in FIG. 14, when the number of sheets P is a predetermined number or more (YES in S18), the sheet bundle S is gripped (S19). That is, as illustrated in FIG. 8B, the CPU 952 drives the sheet gripping member driving motor M11 to grip the upper part of the sheet bundle S while driving the positioning member driving motor M13 to grip the lower part of the sheet bundle S (S19). As used herein, the sheet bundle S means a bundle of the bookbinding target sheets P stacked on the intermediate tray 560.

Then, as illustrated in FIG. 14, the CPU 952 projects the projecting member 830 to the sheet bundle S and moves the sheet gripping member 802 and the positioning member 805 according to a movement amount of the projecting member 830 (S20). That is, as illustrated in FIG. 9A, the CPU 952 drives the projecting motor M9 to project the projecting member 830 to the sheet bundle S, thereby starting the folding process. The sheet gripping member 802 and the positioning member 805 are moved according to the movement amount of the projecting member 830.

Figure 12:
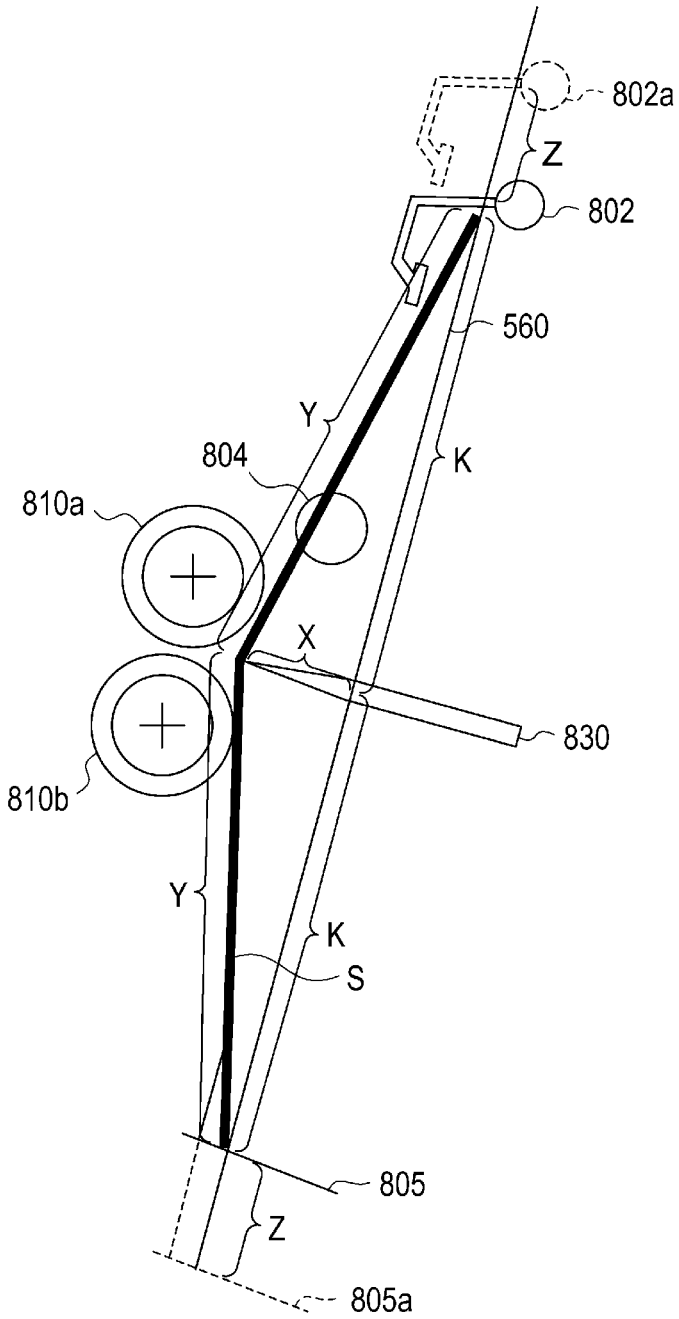
FIG. 12 is a partially enlarged sectional view illustrating a finisher controlling process.

FIG. 12 is a conceptual view illustrating the movement amounts of the sheet gripping member 802 and the positioning member 805. A method of computing the movement amounts of the sheet gripping member 802 and the positioning member 805 will be described with reference to FIG. 12. As illustrated in FIG. 12, before the projecting member 830 projects the sheet bundle S to travel, the position of the sheet gripping member 802 is set to an initial position 802*a*, and the position of the positioning member 805 is set to an initial position 805*a*. It is assumed that Y is a half of a sheet bundle length of the sheet bundle S, X is a distance that the projecting member 830 travels while projecting the sheet bundle S, and Z is a movement amount from each of the initial positions 802*a* and 805*a* of the sheet gripping member 802 and the positioning member 805. At this point, the movement amounts of the sheet gripping member 802 and the positioning member 805 are computed from the following equation (1). The equation (1) is derived as follows. A relationship of $Y^2=X^2+K^2$ holds from the Pythagorean theorem among the half-length Y of the sheet bundle S, the movement amount X of the projecting member 830, and a half-length K between both ends of the projected sheet bundle S. Symbol K is derived from the relationship of $Y^2=X^2+K^2$. The movement amount Z of the sheet gripping member 802 is derived when the length K is subtracted from the half-length Y of the sheet bundle S. Similarly the movement amount Z of the positioning member 805 is derived.

$$\text{movement amount } (Z) = \text{half-length of sheet bundle } (Y) - \sqrt{(\text{half-length of sheet bundle } (Y))^2 - (\text{movement amount of projecting member } (X))^2} \quad \text{[Formula 1]}$$

As illustrated in FIG. 9B, the CPU 952 drives the sheet gripping member moving motor M12 to downwardly (arrow a) move the sheet gripping member 802 by the movement amount (movement amount Z of FIG. 12) (S20). At the same time, the CPU 952 drives the positioning member moving motor M14 to upwardly (arrow b) move the positioning member 805 by the movement amount (movement amount Z of FIG. 12) (S20).

As illustrated in FIG. 10A, the CPU 952 determines whether the sheet bundle S projected by the projecting member 830 travels a predetermined distance while being nipped between the pair of folding rollers 810*a* and 810*b* (S21). When the sheet bundle S projected by the projecting member 830 travels a predetermined distance while being nipped between the pair of folding rollers 810*a* and 810*b* (YES in S21), the CPU 952 determines that the folding process is ended and causes the sheet gripping member 802 and the positioning member 805 to finish gripping the sheet bundle S (S22). That is, as illustrated in FIG. 10B, the CPU 952 drives the sheet gripping member driving motor M11 to finish the grip of the upper part of the sheet bundle S (S22). At the same time, the CPU 952 drives the positioning member driving motor M13 to finish the grip of the lower part of the sheet bundle S (S22).

Figure 11:
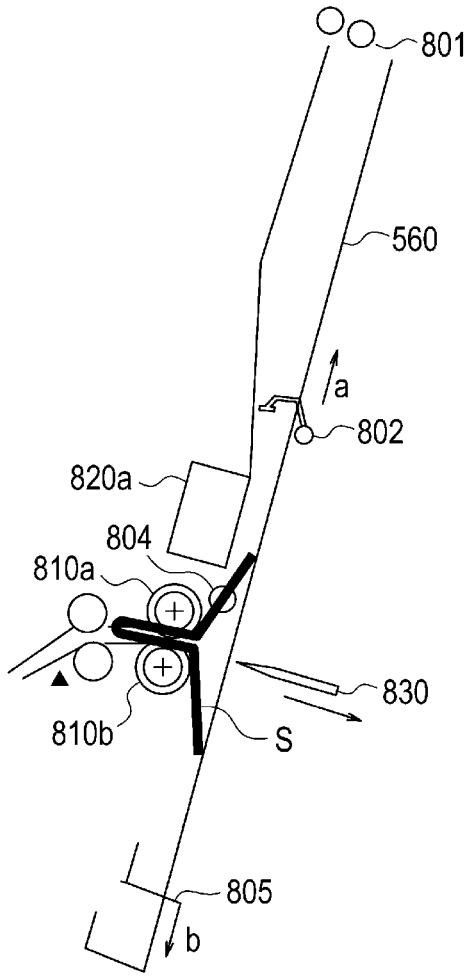
FIG. 11 is a partially enlarged sectional view illustrating a finisher controlling process.

As illustrated in FIG. 11, the CPU 952 drives the sheet gripping member moving motor M12 to upwardly (arrow a) move the sheet gripping member 802 while driving the positioning member moving motor M14 to downwardly (arrow b) move the positioning member 805 (S23). The CPU 952 drives the projecting motor M9 to separate the projecting member 830 from the sheet bundle S (S23).

(In the Case in which the Number of Sheets P of Bookbinding Target is Predetermined Number or Less in Non-Binding Process)

When the non-binding process is performed to the sheet bundle S (YES in S17), the CPU 952 determines whether the number of bookbinding target sheets P of the sheet bundle S is a predetermined number or more (S18). When the number of bookbinding target sheets P of the sheet bundle S is a predetermined number or less (NO in S18), the CPU 952 determines whether the sheet P of the bookbinding target has a predetermined basis weight or more or determines whether the sheet P of the bookbinding target has a predetermined sheet size or less (S31). When the sheet P of the bookbinding target has a predetermined basis weight or less, or when the sheet P of the bookbinding target has a predetermined sheet size or more (NO in S31), the CPU 952 drives the projecting motor M9 to project the projecting member 830 to the sheet bundle S (S26). The CPU 952 determines whether the sheet bundle S projected by the projecting member 830 travels a predetermined distance while being nipped between the pair of folding rollers 810*a* and 810*b* (S27). When the sheet bundle S projected by the projecting member 830 travels a predetermined distance while being nipped between the pair of folding rollers 810*a* and 810*b* (YES in S27), the CPU 952 drives the projecting motor M9 to separate the projecting member 830 from the sheet bundle S (S28).

When the sheet P of the bookbinding target has a predetermined basis weight or more, or when the sheet P of the bookbinding target has a predetermined sheet size or less (YES in S31), the CPU 952 goes to S20 and performs the control to move the sheet gripping member 802 and the positioning member 805.

(In the Case of Binding Process)

When the binding process is performed to the sheet bundle S (NO in S17), the CPU 952 drives the stapler motor M15 to staple the sheet bundle S including the sheets P of the bookbinding targets using the stapler 820*a* (S24). Then the CPU 952 performs the control such that the central part of the sheets P is located at the position of the projecting member 830 while the sheet bundle S is gripped. That is, the CPU 952 drives the sheet gripping member moving motor M12 to downwardly move the sheet gripping member 802 (S25) and concurrently drives the positioning member moving motor M14 to downwardly move the positioning member 805 (S25).

Then the CPU 952 drives the projecting motor M9 to project the projecting member 830 to the sheet bundle S (S26). The CPU 952 determines whether the sheet bundle S projected by the projecting member 830 travels a predetermined distance while being nipped between the pair of folding rollers 810 (S27). When the sheet bundle S projected by the projecting member 830 travels a predetermined distance while being nipped between the pair of folding rollers 810*a* and 810*b* (YES in S27), the CPU 952 drives the projecting motor M9 to separate the projecting member 830 from the sheet bundle S (S28).

(Conveyance Control of Post-Folding Process)

The CPU 952 conveys the sheet bundle S while the sheet bundle S is folded by the pair of folding rollers 810*a* and 810*b* (S29). The CPU 952 discharges the sheet bundle S to the bookbinding tray 850 using the pair of folding rollers 811*a* and 811*b* (S30).

According to the configuration of the embodiment, one end of the sheet bundle S is gripped by the sheet gripping member 802 while the other end is gripped by the positioning member 805, and the sheet bundle S is guided to the pair of folding rollers 810*a* and 810*b* and folded by the projecting operation of the projecting member 830. As a result, the sheet bundle S is folded while the sides at one end and the other end are aligned, and the quality of the bookbinding state is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-183600, filed Aug. 19, 2010, which is hereby incorporated by reference herein in its entirety.

What is claimed is:

1. A sheet processing apparatus comprising:

a conveying portion that conveys sheets in a conveying direction;

a collecting portion that collects the sheets conveyed by the conveying portion and forms a sheet bundle;

a one-end gripping member that grips one end, with respect to the conveying direction, of the sheet bundle stacked on the collecting portion;

an other-end gripping member that grips the other end, with respect to the conveying direction, of the sheet bundle stacked on the collecting portion;

a moving portion that moves the one-end gripping member and the other-end gripping member so as to come close to each other;

a pair of rollers that conveys the sheet bundle while nipping the sheet bundle, thereby folding the sheet bundle;

a projecting member that projects a part between the one end and the other end of the sheet bundle gripped by the one-end gripping member and the other-end gripping member toward the pair of rollers; and a controller that controls the moving portion such that the one-end gripping member and the other-end gripping member come close to each other in synchronization with an operation of projecting the projecting member toward the sheet bundle.

2. The sheet processing apparatus according to claim 1, wherein the controller controls the moving portion to move the one-end gripping member and the other-end gripping member, based on sheet information that the sheet bundle stacked on the collecting portion is a target of a non-binding process.

3. The sheet processing apparatus according to claim 1, wherein the controller controls the moving portion to move the one-end gripping member and the other-end gripping member, based on sheet information that the number of sheets of the sheet bundle stacked on the collecting portion is a predetermined number or more.

4. The sheet processing apparatus according to claim 1, wherein the controller controls the moving portion to move the one-end gripping member and the other-end gripping member, based on sheet information that the sheets constituting the sheet bundle to be folded are rigid sheets or small-size sheets.

5. The sheet processing apparatus according to claim 1, wherein the controller controls the one-end gripping member and the other-end gripping member to finish gripping the sheet bundle and to separate the one-end gripping member, the other-end gripping member, and the projecting member from the sheet bundle, when the sheet bundle travels a predetermined distance while being nipped between the pair of rollers.

6. An image forming system comprising:

an image forming portion that forms images;

a sheet processing apparatus that processes sheets on which the images are formed; and a controller that controls the sheet processing apparatus, wherein the sheet processing apparatus includes:

a conveying portion that conveys sheets in a conveying direction;

a collecting portion that collects the sheets conveyed by the conveying portion and forms a sheet bundle;

a one-end gripping member that grips one end, with respect to the conveying direction, of the sheet bundle stacked on the collecting portion;

an other-end gripping member that grips the other end, with respect to the conveying direction, of the sheet bundle stacked on the collecting portion;

a moving portion that moves the one-end gripping member and the other-end gripping member so as to come close each other;

a pair of rollers that conveys the sheet bundle while nipping the sheet bundle, thereby folding the sheet bundle; and a projecting member that projects a part between the one end and the other end of the sheet bundle gripped by the one-end gripping member and the other-end gripping member toward the pair of rollers, wherein the controller controls the moving portion such that the one-end gripping member and the other-end gripping member come close to each other in synchronization with an operation of projecting the projecting member toward the sheet bundle.

7. The image forming system according to claim 6, wherein the controller controls the moving portion to move the one-end gripping member and the other-end gripping member, based on sheet information that the sheet bundle stacked on the collecting portion is a target of a non-binding process.

8. The image forming system according to claim 6, wherein the controller controls the driving of the moving portion to move the one-end gripping member and the other-end gripping member, based on sheet information that the number of sheets of the sheet bundle stacked on the collecting portion is a predetermined number or more.

9. The image forming system according to claim 6, wherein the controller controls the moving portion to move the one-end gripping member and the other-end gripping member, based on sheet information that the sheets constituting the sheet bundle to be folded are rigid sheets or small-size sheets.

10. The image forming system according to claim 6, wherein the controller controls the one-end gripping member and the other-end gripping member to finish gripping the sheet bundle and to separate the one-end gripping member, the other-end gripping member, and the projecting member from the sheet bundle, when the sheet bundle travels a predetermined distance while being nipped between the pair of rollers.

* * * * *